US005088265A

United States Patent [19]

Suganuma et al.

[11] Patent Number: 5,088,265

[45] Date of Patent: Feb. 18, 1992

[54] APPARATUS FOR PRODUCING SPUN YARN

[75] Inventors: Buro Suganuma, Nagaokakyo; Shinichi Nishimura, Ohtsu; Akihiko Takeshita, Kyoto, all of Japan

[73] Assignee: Murata Kikai Kabushiki Kaisha, Kyoto, Japan

[21] Appl. No.: 600,178

[22] Filed: Oct. 19, 1990

Related U.S. Application Data

[63] Continuation of Ser. No. 264,450, Oct. 28, 1988, abandoned.

[30] Foreign Application Priority Data

Oct. 29, 1987 [JP] Japan ..... 62-274454

[51] Int. Cl.[5] ..... D01H 1/115

[52] U.S. Cl. ..... 57/328; 57/333; 57/343

[58] Field of Search ..... 57/5, 403, 328, 331, 57/332, 333, 334, 341, 343, 344, 346, 329

[56] References Cited

U.S. PATENT DOCUMENTS

| | | | |
|---|---|---|---|
| 3,670,486 | 6/1972 | Murray | 57/402 |
| 3,927,517 | 12/1975 | Kimoto | 57/346 X |
| 4,322,944 | 4/1982 | Sraitr et al. | 57/332 X |
| 4,476,672 | 10/1984 | Anahara et al. | 57/333 |
| 4,489,545 | 12/1984 | Susumu et al. | 57/328 X |
| 4,497,167 | 2/1985 | Nakahara et al. | 57/328 |
| 4,517,794 | 5/1985 | Sakai et al. | 57/261 X |
| 4,635,435 | 1/1987 | Morrison et al. | 57/341 X |
| 4,693,071 | 9/1987 | Morrison | 57/328 X |
| 4,713,931 | 12/1987 | Morrison et al. | 57/331 X |
| 4,719,774 | 1/1988 | Morrison | 57/328 X |
| 4,958,487 | 9/1990 | Suganuma et al. | 57/333 X |

*Primary Examiner*—Joseph J. Hail, III

*Attorney, Agent, or Firm*—Spensley Horn Jubas & Lubitz

[57] ABSTRACT

An apparatus for producing a spun yarn comprising drafting units, delivery rollers and spinning devices disposed between the front rollers of each drafting unit and the corresponding delivery rollers. The spinning device guides a sliver drafter by the drafting unit along a substantially straight line and blows air against the running sliver so that some of the component fibers in the circumference of the sliver are fluffed out and caused to wind around the fibers forming the core of the sliver, and the circumferential speed of the delivery rollers is set to be equal to or higher than that of the front rollers.

8 Claims, 6 Drawing Sheets

FIG. 9
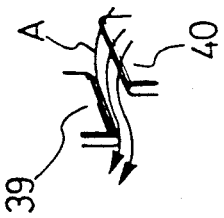
FIG. 10
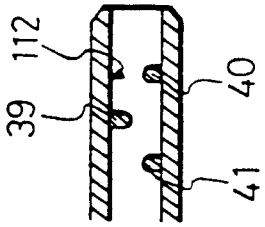
FIG. 7
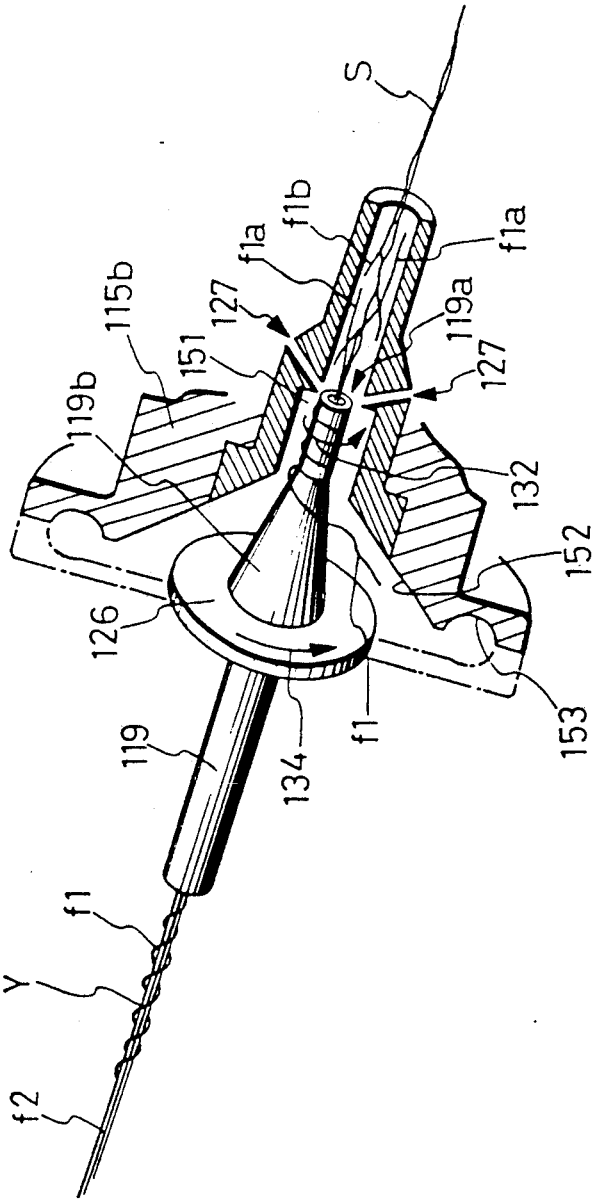
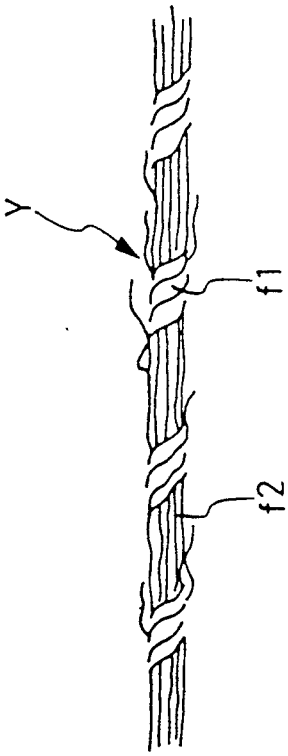
FIG. 8

APPARATUS FOR PRODUCING SPUN YARN

This is a continuation of application Ser. No. 07/264,450 filed on Oct. 28, 1988, now abandoned.

FIELD OF THE INVENTION

This invention relates to an apparatus for producing a spun yarn, and more particularly to an apparatus for applying a twist to a non-twisted sliver drafted by a draft device to produce a spun yarn.

RELATED ART STATEMENT

Conventional spinning machines are roughly classified into three types including a ring type, an open end type and a pneumatic type. Among the three types, a pneumatic type spinning machine has been developed in recent years and has a high spinning capacity several times or so the capacity of a ring type spinning machine. One such pneumatic type spinning machines is disclosed in Japanese Patent Publication No. 53-45422 (U.S. Pat. No. 4,112,658). In the prior art arrangement, two air jetting nozzles are disposed subsequently to a draft device, and the air jetting nozzles individually produce flows of compressed air whirling in the opposite directions to each other to act upon a sliver forwarded from the draft device. The sliver is temporarily twisted by the second nozzle, and the thus temporarily twisted sliver is ballooned by the first nozzle. By such ballooning, part of fibers of the sliver are caused to wind around some other fibers, and then as the sliver passes through and is untwisted by the second nozzle, the fibers are caused to wind around each other strongly. A spun yarn is produced in this manner.

If a yarn produced on such a conventional pneumatic type spinning machine as described above is examined closely, then it can be found out that the yarn is a bound spun yarn wherein the other fibers wind spirally around non-twisted or loosely twisted core fibers. The ratio in quantity between the core fibers and the winding fibers, the winding manner of the fibers and so on can be changed to some degree by changing yarn spinning conditions in various manners and properties of a yarn such as the yarn strength can be changed accordingly. However, if the length of fibers increases, then it is difficult to stabilize behaviors of winding fibers on such a pneumatic type spinning machine. Further, since the spinning machine employs two nozzles, there is a problem that consumption of compressed air is great in quantity and hence the cost of energy is high. Also there is a problem that the spinning machine has a considerable fault in capacity of spinning of long fibers such as fibers of wool.

OBJECT AND SUMMARY OF THE INVENTION

It is an object of the present invention to provide a very novel spinning apparatus by which a spun yarn of a high quality can be produced at a high speed.

An embodiment of the present on provides an apparatus for producing a spun yarn including drafting units, spinning devices and delivery roller, characterized in that the spinning device is disposed between the front rollers of each drafting unit and the corresponding delivery rollers, the spinning device guides a sliver drafted by the drafting unit along a substantially straight line and blows air against the running sliver so that some of the component fibers in the circumference of the sliver are fluffed out and caused to wind around the fibers forming the core of the sliver, and the circumferential speed of the delivery rollers is equal to or higher than that of the front rollers

DETAILED DESCRIPTION OF PREFERRED EMBODIMENTS

Figure 5:
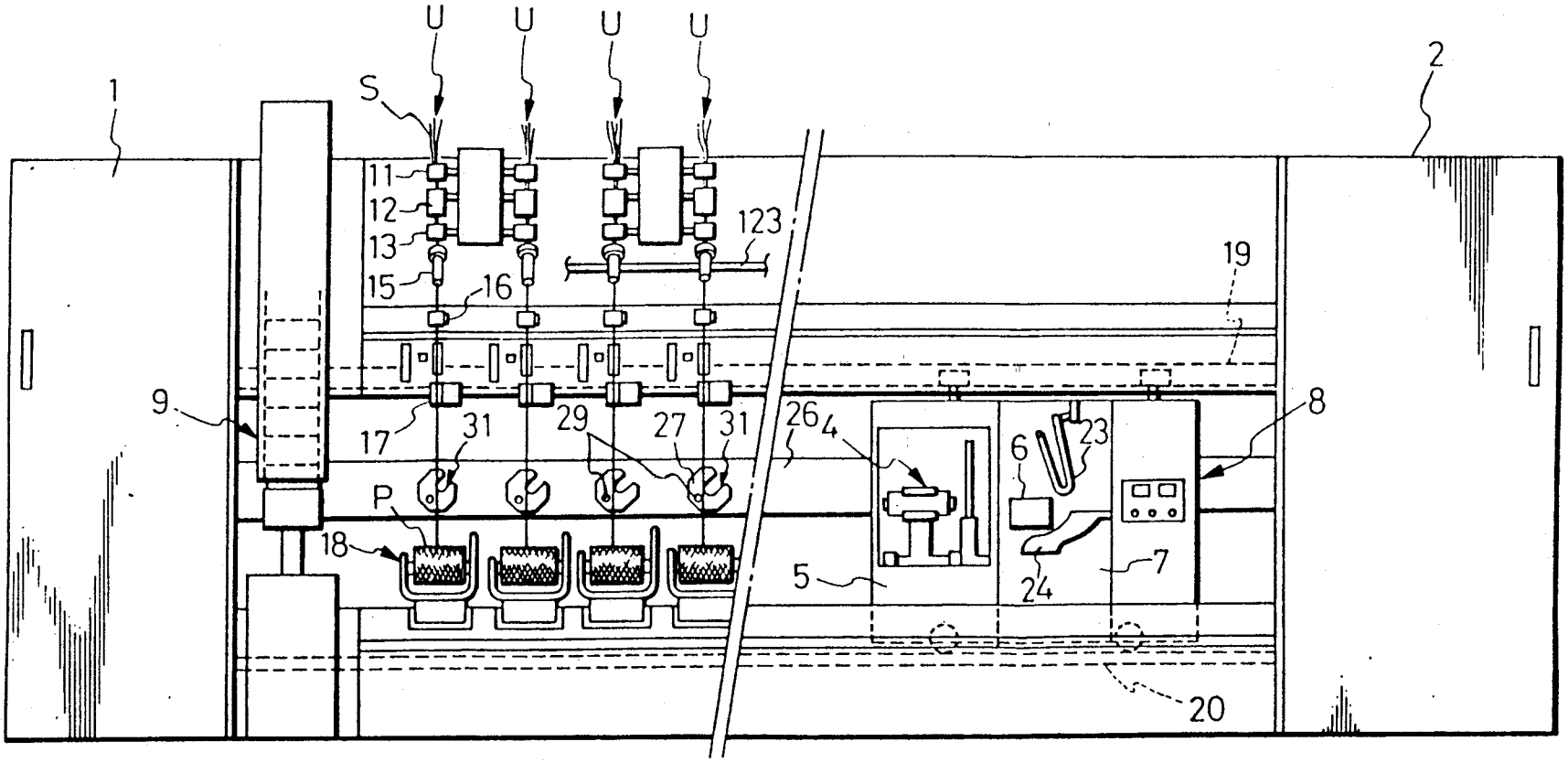

FIG. 5 shows a front elevational view of a spinning machine in which a spun yarn producing apparatus according to the present invention is incorporated. The spinning machine includes a large number of spinning units U disposed in a juxtaposed relationship on a frame F having a channel shape in side elevation (FIG. 6) and extending between a prime mover box 1 and a blower box 2. A bogie traveling spacing 3 is provided along the row of the units U in the longitudinal direction of a base of the spinning machine, and a traveling bogie 8 travels in the spacing 3. The traveling bogie 8 includes a doffing bogie 5 equipped with a doffing device 4 and a yarn splicing bogie 7 equipped with a yarn splicing device 6 and formed in an integral relationship with the doffing bogie 5. Reference numeral 9 denotes a paper tube supply device located between the prime mover box 1 and the spinning units U for supplying paper tubes to the doffing device 4.

Figure 6:
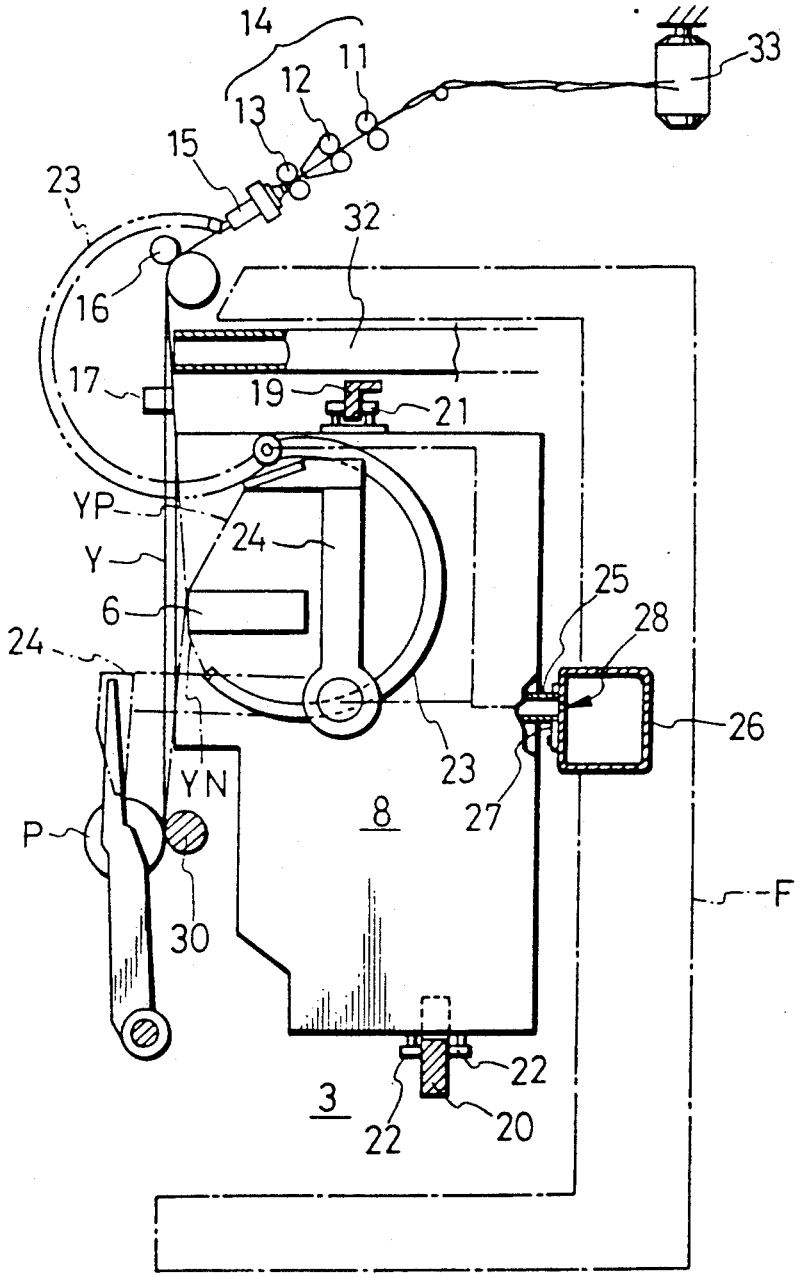

FIG. 6 is a schematic side elevational view, and each of the spinning units U is composed of a three-line type draft device 14 consisting of a pair of back rollers 11, a pair of middle rollers 12 and a pair of front rollers 13 (a four-line type draft device may be used instead in order to attain a high draft rate), a spun yarn producing apparatus 15 according to an embodiment of the present invention which will be hereinafter described in detail, a delivery roller 16 for drawing out a spun yarn Y produced on the producing apparatus 15, a slub catcher 17 for detecting a fattened portion of the spun yarn Y, and a winding device 18 for winding the yarn Y into a package while traversing the yarn Y.

Reference numerals 19 and 20 denote rails which are held between pairs of clamping rollers 21 and 22, respectively, provided at upper and lower portions of the bogie 8 for guiding the bogie 8, and reference numeral 30 denotes a friction roller held in rolling contact with the package P.

A suction pipe 23 for sucking and gripping an upper yarn YN on the spinning out side and introducing the same into the yarn splicing device 6 and a suction mouth 24 for sucking and gripping a lower yarn YP on the package P side and introducing the same into the yarn splicing device 6 are provided for individual pivotal motion as shown by long and short dash lines in FIG. 6 on the yarn splicing bogie 7. A connecting duct 25 is provided in a contiguous relationship on the base end sides of the suction members 23 and 24 and normally urged to project to the rear of the bogie 7 by a spring not shown so that the duct 25 may be contacted with a suction duct 26 extending in the spacing 3 along the units U to achieve sucking by way of the suction pipe 23 and the suction mouth 24.

Reference numeral 27 denotes a closing plate for closing a hole 28 perforated in a front wall of the suction duct 26. The closing plate 27 is supported for pivotal motion in leftward and rightward directions by an angle of about 90 degrees around a fulcrum 29. When the bogie 8 comes near, the connecting duct 25 is engaged with a U-shaped recess 31 of the closing plate 27 and pivots the closing plate 27 to a substantially vertical posture in which the hole 28 and the connecting duct 25 are coupled directly to each other in order to apply a sucking action to the suction pipe 23 and the suction mouth 24 at the position.

Reference numeral 32 denotes a slack tube formed from an elongated tubular pipe which is opened to a yarn path between the delivery roller 16 and the slub catcher 17. The slack tube 32 is connected at a base end side thereof to the suction duct 26.

A non-twisted worsted yarn or sliver S of wool wound on a yarn supply package 33 is passed through the draft device 14 and then introduced into the spun yarn producing apparatus 15 of the present invention on which it is formed into a spun yarn Y, and thereafter the spun yarn Y is drawn out by the delivery roller 16 and then wound onto a package P.

Figure 1:
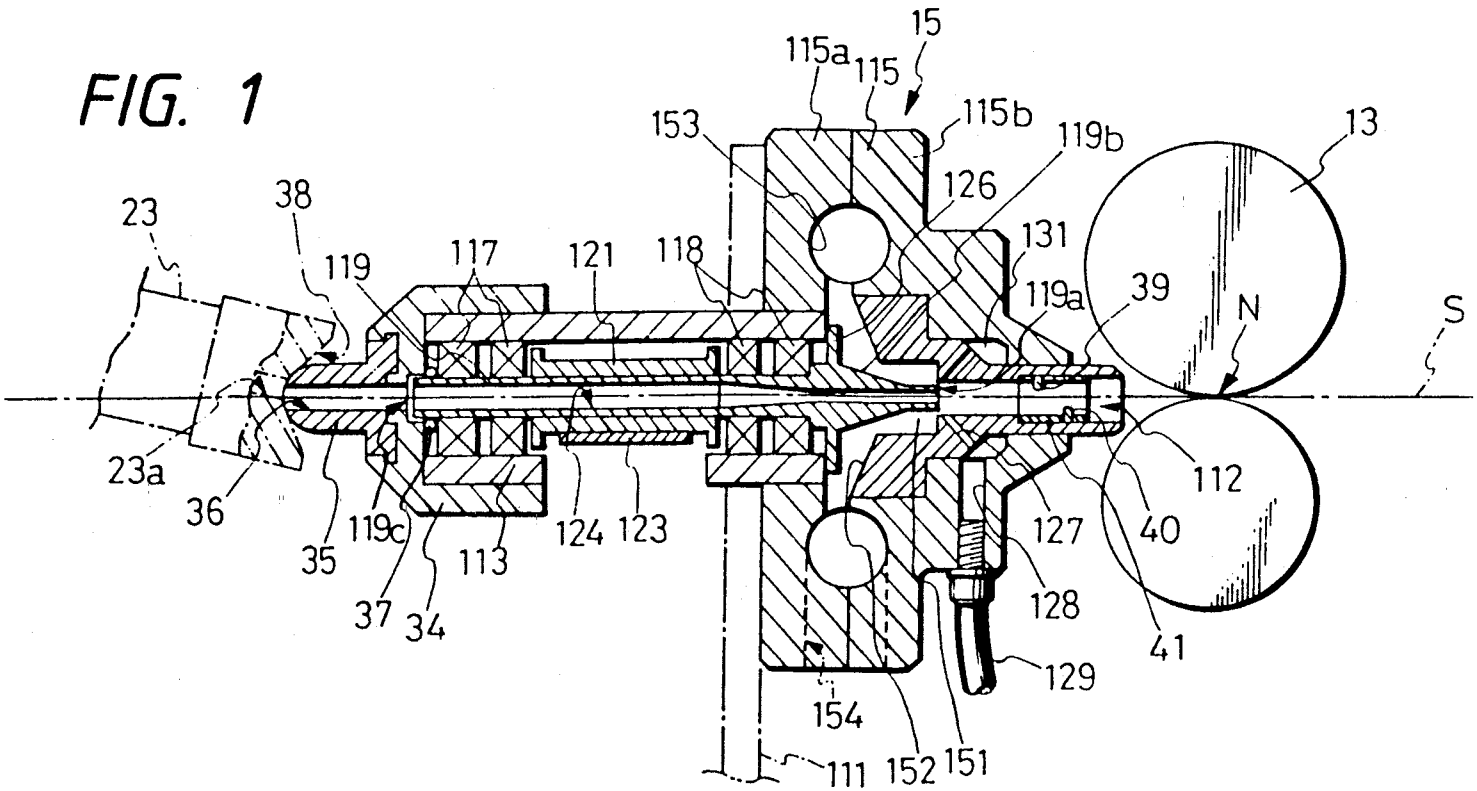
FIG. 1 is a vertical sectional side elevational view of an apparatus for producing a spun yarn according to an embodiment of the present invention, FIG. 2 a front elevational view of a rear part of a casing and a rotary pipe, FIG. 3 a front elevational view of a nozzle section, FIG. 4 a front elevational view of a guide path, FIG. 5 a front elevational view of an entire spinning machine, FIG. 6 a schematic side elevational view of the spinning machine, FIG. 7 an explanatory view illustrating a producing process of a spun yarn, FIG. 8 a view showing an appearance of a spun yarn produced, FIG. 9 an explanatory view illustrating an action of a dam member, FIG. 10 a vertical sectional view illustrating another example of dam member, and FIG. 11 a graph showing the results of tensile strength tests of spun yarns spun on the spinning machine.
Figure 2:
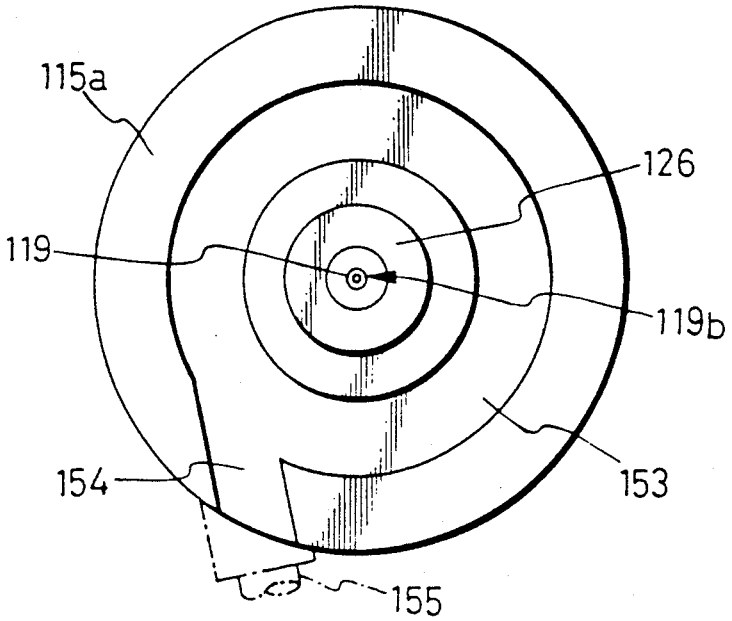

Detailed structure of the spun yarn producing device 15 is shown in FIG. 1, and a long and short dash line extending in the leftward and rightward directions in the same figure indicates a traveling path of a sliver S or a spun yarn Y.

Reference numeral 111 denotes a supporting plate secured to the frame F, and a hollow tubular bearing 113 is secured to the plate 111 by means of a screw or the like. Further, a casing 115 for a rotary pipe and a rotary disk which will be hereinafter described is secured to the plate 111 by means of a screw or the like. The casing 115 is composed of a pair of front and rear divided parts 115*a* and 115*b* which are screwed to each other.

A rotary pipe 119 is supported for rotation within the bearing 113 by means of two pairs of bearings 117 and 118. A hollow pulley 121 is fitted on an outer periphery of the pipe 119.

Reference numeral 123 denotes an endless driving belt which extends along the units U in such a manner as to contact with an outer periphery of the pulley 121 and is driven to circulate by a motor not shown. As the belt 123 is circulated, the rotary pipe 119 is rotated at a high speed together with the pulley 121. A rotary plate 126 is formed in an integral relationship at a location of the rotary pipe 119 in front of the bearings 118.

A sliver path 124 is formed at and extends through the center of the rotary pipe 119, and the spun yarn producing apparatus 15 is disposed such that the center of the path 124 and the center of the hollow portion of the casing 115 may both be positioned on the same straight line coincident with the traveling path of the sliver S and besides the distance between an entrance 119*a* of the rotary pipe 119 and a nip point N of the front rollers 13 may be smaller than an average length of fibers which constitute the sliver S. The outer diameter of the entrance portion 119*a* of the rotary pipe 119 is sufficiently small, and a portion of the rotary pipe 119 next to the entrance portion 119*a* is formed into a conical shape 119*b* wherein the outer diameter thereof is constant over a predetermined section and then increases toward the rotary plate 126. Further, a portion of the casing 115*b* which covers the rotary pipe 119 and the rotary plate 126 is formed into a cylindrical hollow chamber 151 of a small diameter adjacent the entrance portion 119*a* of the rotary pipe 119, and a portion next to the hollow chamber 151 is formed into a conical hollow chamber 152 which is opened at a large angle.

Further, a portion forwardly of the small diameter hollow chamber 151 is formed into a cylinder of a diameter a little greater than the diameter of an end of the rotary pipe 119, and the cylindrical portion serves as a guide path 112 for a sliver S. An annular hollow chamber 153 and a tangential air vent hole 154 contiguous to the hollow chamber 153 are formed in an outer peripheral portion of the spun yarn producing apparatus 15 around the conical hollow chamber 152.

An air suction pipe 155 is connected to the air vent hole 154.

Figure 3:
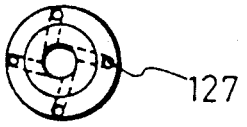

Further, a hollow air chamber 131 is formed in the inside of the casing 115*b*, and four air jetting nozzles 127 are formed in the casing 115*b* such that they may be directed from the air chamber 131 toward the entrance 119*a* of the rotary pipe 119 and in tangential directions to the hollow chamber 151 (FIGS. 1 and 3). An air hose 129 is connected to the air chamber 131 by way of a hole 128. The directions of the nozzles 127 are set identical to the direction of rotation of the rotary pipe 119.

Compressed air supplied from the hose 129 flows into the air chamber 131 and is then jetted from the nozzles 127 into the hollow chamber 151 to produce air flows whirling at a high speed near the entrance 119*a* of the rotary pipe 119.

After whirling within the hollow chamber 151, the air flows are diffused outwardly while whirling relatively slowly within the above described conical hollow chamber 152 and then introduced into and discharged by way of the vent hole 154. In the meantime, the air flows simultaneously produce a suction air flow which flows into the hollow portion of the casing 115 from the nip point N of the front rollers 13.

Further, reference numeral 34 denotes a cap fitted to a rear end of the bearing 113, and a projection 35 made of a ceramic material and having a semi-spherical end is secured in an integral relationship to the cap 34. The cap 34 has a through-hole 36 perforated therein which extends through the projection 35 and communicates with an exit 119*c* of the rotary pipe 119. Thus, if the suction pipe 23 is pivoted to the position shown by chain lines in FIG. 1 wherein a sucking portion 23*a* thereof is connected to the through-hole 36, then the entire region of the sliver path 124 within the rotary pipe 119 is put into a negative pressure so that the sliver S is positively sucked into the rotary pipe 119 by way of the entrance of the rotary pipe 119.

Reference numeral 37 denotes an O-ring fitted at an end portion of the rotary pipe 119, and as the O-ring 37 is closely contacted with an inner face of the cap 34, leakage of air between the through-hole 36 and the rotary pipe 119 is prevented by the O-ring 37.

Meanwhile, an end of the suction pipe 23 is formed to have a conical face 38.

Further, a pair of such dam members 39 and 40 as described below are provided at a cylindrical portion at a forward end of the casing which defines the guide path 112 therein in order to introduce a sliver of a substantially flattened configuration forwarded from the front rollers 13 smoothly into the entrance of the rotary pipe 119.

In particular, a countersunk hole is formed in an inner wall of the cylindrical portion 112, and an auxiliary cylinder 41 is inserted to a substantially central position of the cylindrical portion 112. A pair of dam members 39 and 40 each in the form of a plate are provided at upper and lower locations displaced in the forward and rearward directions in the interior of the cylinder 41.

Figure 4:
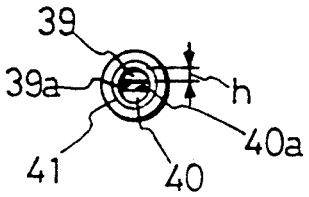

The height h of the individual dam members 39 and 40 is set to a value smaller than one half the inner diameter of the cylinder 41, and upper sides 39*a* and 40*a* of them are formed to extend horizontally (that is, in parallel to a nip plane of the front rollers 13). Thus, the dam members 39 and 40 have such a structure that, when the casing 115 is viewed from the front side thereof, the entrance of the rotary pipe 119 can be seen a little through a horizontally elongated gap between the two dam members 39 and 40 as seen in FIG. 4.

In the following, a process of producing a yarn on the fiber machine described above will be described.

A sliver S drafted by the draft device 14 and forwarded from the front rollers 13 is drawn into the guide path 112 by a suction air flow which acts toward the path forwardly of the cylindrical portion (guide path) 112. However, since the end of the suction nozzle 23 has been pivoted and contacted with the projection 35 as shown by chain lines in FIG. 1 in prior to such forwarding of the sliver S from the front rollers 13, an air flow to suck the sliver S into the rotary pipe 119 is produced also near the entrance of the rotary pipe 119 so that the sliver S which is advanced toward the interior within the guide path 112 is sucked smoothly into the rotary pipe 119 by such a suction air flow at the entrance of the rotary pipe 119.

An upper yarn UN sucked into the suction pipe 23 past the interior of the rotary pipe 119 (already having the form of a yarn since it has passed the rotary pipe 119) is introduced into the yarn splicing device 6 upon pivotal motion of the suction pipe 23 to the position shown by solid lines in FIG. 6 and then spliced to a lower yarn YP on the package P side which has been similarly introduced into the yarn splicing device 6 by the suction mouth 24.

Also during such a yarn splicing operation, the yarn Y spun out from the producing device 15 is sucked into and by the slack tube 32 in order to remove possible slackening thereof.

After the yarn splicing operation is completed, the yarn is fed along the normal yarn path (FIG. 6) interconnecting the delivery roller 16, slub catcher 17 and friction roller 30 in a straight line and is then wound onto the package P.

It is to be noted that the peripheral speed of the delivery roller 16 is set a little higher than the peripheral speed of the front rollers 13 so that a spinning process may be carried out while tension is always applied to a sliver S passing through the producing device 15.

In the following, the spinning process in the producing device will be described.

In particular, a sliver S is acted upon near the entrance of the rotary pipe 119 by compressed air flows jetted from the air jetting nozzles 127 and whirling in the direction of an arrow mark 132 as illustrated in FIG. 7 so that it is temporarily twisted a little in the same direction. Since fibers located at a central portion of the sliver S are not directly exposed to the air flows, they are untwisted to their original condition at a position behind the entrance 119*a* of the rotary pipe 119. To the contrary, fibers fl located at or near an outer periphery of the sliver S are exposed directly to the air flows and acted upon by such a force that they may be separated from the sliver S. However, since leading ends of the fibers S have temporary twists thereon when they are positioned at the rotary pipe entrance 119*a*, they are not separated readily from the sliver S. Meanwhile, since trailing ends of the fibers are either nipped between the front rollers 13 as seen in FIG. 1 or located far from the nozzles 127 so that they are not acted upon very much by the air flows, they are not yet separated from the sliver S.

Subsequently, when the trailing ends of the fibers fl are spaced away from the front rollers 13 and then approach the air jetting nozzles 127, they are acted upon strongly by a force of the air flows from the nozzles 127 so that they are separated from the sliver S. In this instance, the leading ends of the fibers fl are temporarily twisted partially and inserted into the rotary pipe in which the air flow acts only a little so that they are not separated from the sliver S while only the trailing ends fla of the fibers which have been little acted upon by a temporarily twisting action are separated from the sliver S. The trailing ends of the fibers thus separated are caused to wind in one or a plurality of turns round the entrance portion of the rotary pipe 119 by an action of the air flows and then wind a little round the conical portion 119*b* of the rotary pipe 119 whereafter they are extended outwardly under the guidance of the rotary plate 126.

Subsequently, since the sliver S continues to move leftwardly while the rotary pipe 119 is rotated in the direction of an arrow mark 34, the trailing ends fla of the fibers fl are gradually drawn out while being whirled around the sliver S.

As a result, the fibers fl wind spirally round the sliver S so that the sliver S is formed into a bound spun yarn Y, and the spun yarn Y passes the sliver path 124.

Since in the producing process of the yarn Y described above the fibers fl are separated from the entire outer periphery of the sliver S and fibers located inside of the fibers fl are exposed to and further separated by air flows as a result of such separation of the fibers fl, a large number of fibers are continuously separated. Those fibers thus separated are distributed uniformly over the outer periphery and the conical portion 119*b* of the rotary pipe 119 and wind uniformly around fibers which make a core. The winding direction of the winding fibers fl depends upon the direction of rotation of the rotary pipe 119, and when the pipe 119 rotates in the direction of the arrow mark 134, the fibers fl wind in the direction of the Z twist, but when the pipe 119 rotates in the reverse direction, the fibers fl wind in the direction of the S twist. The whirling direction of the air flows by the air jetting nozzles 127 is preferably set to the same direction as the direction of rotation of the rotary pipe 119 so that the air flows may not disturb the winding direction of the winding fibers fl described above and the leading ends of the fibers may not be separated by turning motion of the trailing ends of the fibers.

FIG. 8 shows an appearance of a spun yarn Y produced through the spinning process described above. The characteristic of the spun yarn Y resides in that it has a basic structure wherein winding fibers fl wind around core fibers f2 and little disorder can be found in an arrangement of the fibers fl and f2, particularly of the winding fibers fl. The number and the winding angle of the winding fibers fl are uniform over the yarn Y along the direction of the length of the yarn Y. Accordingly, the yarn Y has little unevenness in thickness and has little fluff or loops.

It is to be noted that, while it seems that such a case may occur in the producing process of a yarn Y on the apparatus of the present invention described above that the leading ends fl*b* of the fibers on the surface of the sliver S are separated from the sliver S and wind round the outer periphery of the sliver S, as far as the yarn Y produced on the apparatus is surveyed, winding fibers produced in this manner are comparatively small in quantity, and it seems that most of winding fibers are produced by separation of the trailing ends of the fibers.

A process wherein the leading ends flb of the fibers are separated from the sliver S and make winding fibers will now be described. When the fibers of which the leading ends lie on the surface of the sliver S so that they are readily separated from the sliver S and the trailing ends are located at a central portion of the sliver S so that they are not readily separated from the sliver S are acted upon by air flows from the nozzles 127, the leading end portions of the fibers are separated from the sliver S and wind round the rotary pipe 119 before they reach the entrance 119*a* of the rotary pipe 119. In this instance, the trailing ends of the fibers remain in the sliver S, and then as the sliver S is further fed and the rotary pipe 119 is rotated, the fibers are caused to wind spirally round the outer periphery of the sliver S and thus make winding fibers. The number and the winding angle of the winding fibers are similar to those of the fibers the trailing ends of which are separated as described hereinabove.

Thus, while the yarn strength increases as the number of the winding fibers winding around the outer periphery of the sliver S increases, since in the spinning process described above the peripheral speed of the delivery roller 16 is set a little higher than the peripheral speed of the front rollers 13 so the process may normally take place under some tension, separation of the trailing ends fla of the fibers from the sliver S readily occurs in the spinning process, and accordingly a greater number of winding fibers are obtained as much.

In particular, where the distance between the front rollers 13 and the deliver roller 16 is represented by L, the maximum length of fibers of a sliver handled by D, the peripheral speed of the deliver roller 16 by Vb, and the peripheral speed of the front rollers 13 by Va, good results were obtained when Vb is within the range from $1.00\times Va$ to $1.05\times Va$ in the case of $D>L$ and when Vb is within the range from $1.00\times Va$ to $1.10\times Va$ in the case of $D<L$.

Figure 11:
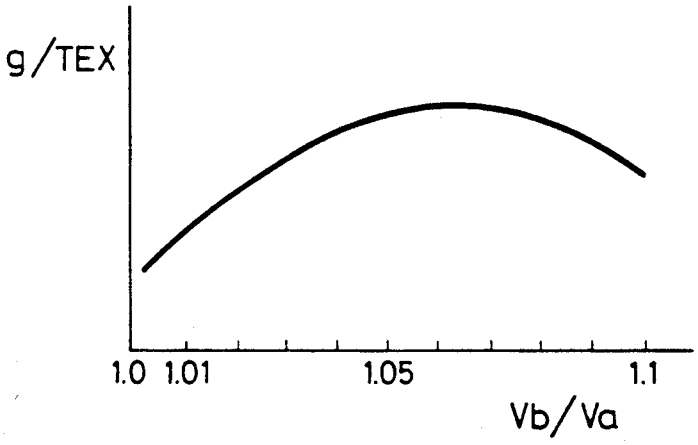

FIG. 11 is a graph showing the results of tests of the tensile strength of spun yarns spun on the spinning machine of the present invention.

In FIG. 11, the ratio of the circumferential speed of the delivery rollers 16 to that of the front rollers 13, namely, Vb/Va, is measured on the horizontal axis, and the tensile strength (g/Tex) of the spun yarns is measured on the vertical axis.

General morphologies of curves for different spinning conditions were substantially similar to that shown in FIG. 11 regardless of the type of fibers and fiber length.

The maximum tensile strength for spun yarns from a rovings of 100% wool fibers was in the range of 5 to 5.5 g/Tex, and the maximum tensile strength for spun yarns spun from rovings of 50% wool fibers and 50% polyester fibers was in the range of 10 to 12 g/Tex.

It is inferred from the foregoing results that the drafted fiber bundle is stretched in a state scarcely before breakage due to fiber slippage when the drafted fiber bundle is subjected to the spinning operation under a small tension, and hence the ends of the fibers are liable to be fluffed out because only a small binding force acts on the ends of the fibers.

In short, to place a sliver under a little tension in the course of spinning is to make a condition just before a so-called yarn break takes place, and it is considered that the bound force of fiber ends bound in a sliver is weak as much and separation of the fiber ends occurs readily.

Further, since a spun yarn Y wound on a package P past the delivery roller 16 is in a condition under no tension, a core fiber bundle f2 (FIG. 8) in a condition in which it is tightened under tension tends to get loose and expand itself as a reaction. However, since the core fiber bundle f2 is wound therearound by winding fibers fl, on the contrary the winding fibers fl will bite into the core fibers f2 to a degree corresponding to such looseness of the core fibers. Consequently, strong winding tightening by the winding fibers fl can be obtained, which will raise the strength of the yarn.

In the following, a process of introducing a sliver S forwarded from the front rollers 13 into the rotary pipe 119 upon starting of spinning will be examined. A sliver S forwarded from the front rollers 13 has a flattened configuration wherein it is expanded in the leftward and rightward directions because it has been pressed by the upper and lower front rollers 13. It can be considered that, when the sliver S in such a flattened configuration is advanced to the interior within the cylindrical guide path 112, it is influenced by whirling air flows near the entrance of the pipe 119 so that it is twisted or snaked while being advanced. Thus, with the mere cylindrical guide path 112 in which no such a dam as the dams 39 and 40 is provided, the probability that the sliver S may successfully reach and be sucked into the entrance of the pipe 119 is low. To the contrary, where the dam members 39 and 40 are provided in the cylindrical guide path 112, an air flow in the guide path 112 will make a parallel laminar air flow A having a small whirling component so that it guides and introduces the flattened sliver S well to the entrance of the pipe 119 (FIG. 9). The sliver S having reached the entrance of the pipe 119 is then sucked into the pipe 119 by a sucking air flow near the entrance.

Accordingly, it is preferable to provide the dam members 49 and 40 at upper and lower locations spaced in the forward and rearward directions from each other as in the embodiment described above, and a good result cannot be anticipated with only one of the dams. Otherwise, however, three or more dam members 39, 40, 41, . . . may be provided in a zigzag arrangement at upper and lower locations spaced in the forward and rearward directions from each other (FIG. 10).

Further, while the upper sides of the dam members 39 and 40 preferably have a straight configuration, they may otherwise have a curved configuration such as an arcuate configuration, and while the height h of the dam members 39 and 40 has preferably a value a little smaller than (equal to about 80 to 90 percent or so of) one half the diameter of the guide path 112 as in the embodiment described above, it may otherwise have a value a little greater or smaller than the preferable value.

In particular, if the height h exceeds one half the diameter of the guide path 112, then a sliver S will be snaked upwardly and downwardly while being advanced. Accordingly, smooth introduction is hindered as much. On the contrary, if the height h is too small, it can be considered that the guiding action described above is weakened. In the example described above, a good result were obtained when the height h was set such that the vertical dimension of the horizontally elongated gap (FIG. 4) when the guide path 112 is viewed in front elevation is about 1 mm.

As is apparent from the foregoing description, the spinning device of the present invention fluffs out the fibers of the drafted fiber bundle and causes the fluffed-out fibers wind around the core fibers without using the action of ballooning. Accordingly, the spinning device is able to spin a spun yarn steadily from fiber bundles consisting of long fibers. Since the spinning device of the present invention does not use the action of ballooning, the spinning device is able to spin the drafted fiber bundle under a stable predetermined tension by operating the delivery rollers at a circumferential speed higher than that of the front roller, so that winding fibers are increased and thereby spun yarns having high tensile strength are produced.

What is claimed is:

1. An apparatus for producing spun yarn from a sliver including a plurality of fibers defining a sliver core and a sliver periphery, the apparatus comprising:

a drafting device including a pair of front rollers rotatable at a first circumferential speed, a delivery device including a pair of delivery rollers rotatable at a second circumferential speed, the second circumferential speed being not less than the first circumferential speed, a spinning device disposed between the drafting device and the delivery device, the spinning device comprising:

a rotary pipe having an entrance and defining a sliver path for passing a sliver therethrough, a rotary plate integral with the rotary pipe and spaced from the entrance of the rotary pipe, a casing for covering the rotary pipe and the rotary plate, a guide path for introducing and guiding a sliver to the entrance of the rotary pipe, guide means for guiding the sliver along a substantially straight line, and jet means for blowing air against the sliver, whereby at least a portion of the fibers adjacent the sliver periphery are fluffed out and caused to wind around at least a portion of the fibers adjacent the sliver core.

2. An apparatus for producing a spun yarn as in claim 1 wherein the sliver further comprises a plurality of fibers of varying length, the spinning device further includes an entrance, the pair of front rollers defines a nip point, and the distance between the entrance of the spinning device and the nip point of the front rollers is smaller than the average length of the plurality of fibers of the sliver.

3. An apparatus as claimed in claim 1, wherein the second circumferential speed is greater than the first circumferential speed.

4. An apparatus as claimed in claim 1, wherein:

$V_A \leqq V_B \leqq 1.05V_A$ for $D > L$;

$V_A \leqq V_B \leqq 1.10V_A$ for $D < L$;

$V_A$ representing the first circumferential speed;

$V_B$ representing the second circumferential speed;

D representing the maximum length of the fibers of the sliver; and

L representing the distance between the pair of front rollers and the pair of delivery rollers.

5. An apparatus as claimed in claim 1, wherein the second circumferential speed is greater than the first circumferential speed.

6. An apparatus for producing a spun yarn from a sliver according to claim 1, wherein the rotary pipe includes a conical-shaped portion spaced a predetermined distance from the entrance.

7. An apparatus for producing a spun yarn from a sliver according to claim 6, wherein the rotary plate is formed integral with the conical-shaped portion of the rotary pipe.

8. An apparatus for producing spun yarn from a sliver according to claim 1, wherein the spinning device includes rotation drive means for rotating the rotary pipe, wherein the rotary pipe continuously rotates when spun yarn is being produced.

* * * * *